US005692379A

United States Patent [19]

Gallivan et al.

[11] Patent Number: 5,692,379

[45] Date of Patent: Dec. 2, 1997

[54] LONG TERM THERMALLY STABLE CRYOSTAT

[75] Inventors: James R. Gallivan, Pomona, Calif.; Richard D. Ford, Green Valley, Ariz.

[73] Assignee: Hughes Aircraft Company, Los Angeles, Calif.

[21] Appl. No.: 477,780

[22] Filed: Jun. 7, 1995

[51] Int. Cl.[6] ..... F25B 19/02

[52] U.S. Cl. ..... 62/51.2; 62/51.1

[58] Field of Search ..... 62/51.2, 51.1

[56] References Cited

U.S. PATENT DOCUMENTS 4,479,367 10/1984 Buller ..... 62/51.2

5,119,637 6/1992 Bard et al. ..... 62/51.2

*Primary Examiner*—Ronald C. Capossela

*Attorney, Agent, or Firm*—C. D. Brown; W. K. Denson-Low

[57] ABSTRACT

A long-term thermally stable cryostat (40). The cryostat (40) pre-cools an incoming high-pressure gas, converts it to a cold liquid, contains the liquid, and cools an item by allowing the liquid to acquire heat from the item and boil into an exhaust gas, while maintaining an absolute pressure in the container to reduce thermal noise due to altitude-induced pressure changes. In specific embodiments, the cryostat (40) includes a hollow mandrel (52) disposed within a cooling volume (64) mounted within a dewar vacuum area (58). Pre-cooling fins (44) spiral around the hollow mandrel (52) within the cooling volume (64) and circulate an incoming high-pressure gas around the mandrel (52). A flow restrictor (60) receives the incoming gas from the pre-cooling fins (44) and releases it into the cooling volume (64), thereby converting the incoming gas into a cold liquid which can acquire heat from the item and boil into an exhaust gas. A pressure back plate (48) having a vent path therein and an O-ring (56) confine a first volume of the exhaust gas flowing past the pre-cooling fins (44) to pre-cool the incoming gas. An absolute pressure regulator (50) in communication with an end of the mandrel (52) receives a second volume of the exhaust gas flowing through the mandrel (52) to maintain an absolute pressure in the cooling volume (64).

12 Claims, 1 Drawing Sheet

FIG. 1
PRIOR ART
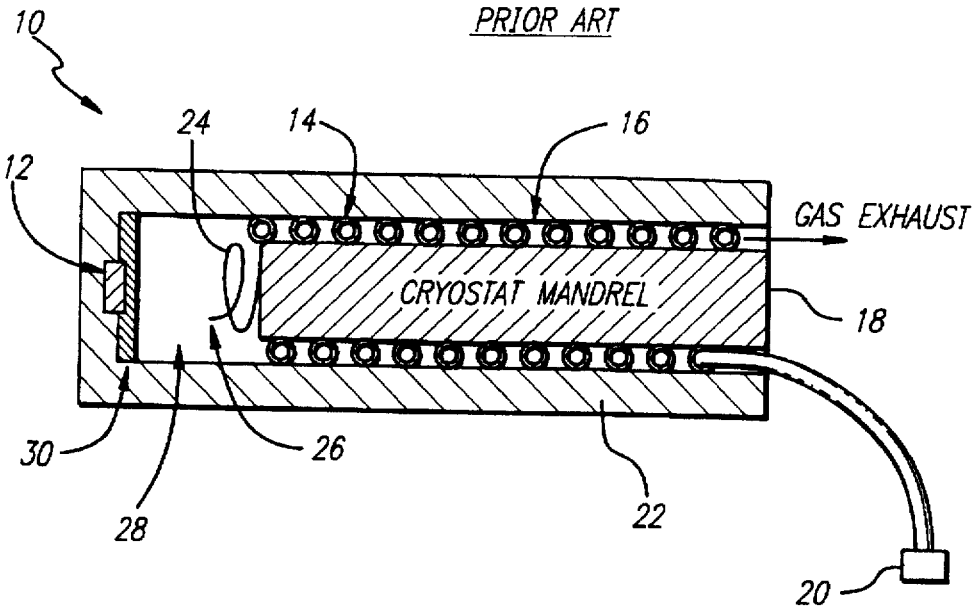
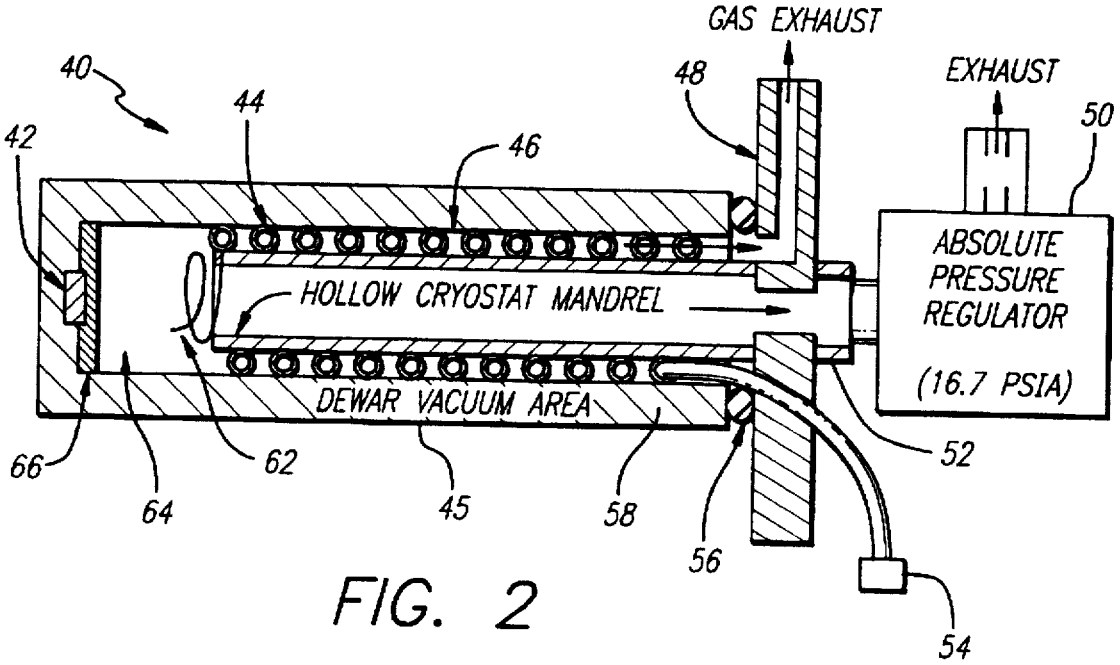
FIG. 2

LONG TERM THERMALLY STABLE CRYOSTAT

This invention was made with Government support. The Government has certain rights in this invention.

BACKGROUND OF THE INVENTION

1. Field of the Invention

The present invention relates to cryogenic cooling systems. More specifically, the present invention relates to systems and techniques for reducing thermal noise in cryostats.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art

In a traditional Joule-Thompson cryostat, a high pressure gas such as nitrogen is pre-cooled and converted to a cryogenically cool liquid on expansion in a cooling volume. The liquid is used to cool a cold finger, which in turn can be used to cool, for example, an infrared (IR) sensor. The liquid boils into a gas and is sent through heat exchanger fins to cool the incoming high-pressure warm gas.

Temperature at the cold finger of a cryostat is found to vary significantly, resulting in "thermal noise." Any variation in temperature causes changes in the output signals of the DC-coupled IR sensors. Because the changes vary for each IR sensor, fixed pattern spatial noise is induced on the output scene, with a corresponding decrease in sensitivity. The major sources of thermal noise are effects that change the pressure in the area where the liquid nitrogen is boiling, since the temperature of the boiling gas is a strong function of the absolute pressure. For example, a pressure change due to a change in altitude causes a temperature change, resulting in thermal noise.

In large cryogenic systems, the pressure and temperature of the liquid nitrogen in the cryostat can be controlled with a pressure regulator with separate regulator tubes attached to the cooling volume. Such larger cryostat designs require greater cooling time, space, and coolant, and are impractical in small systems which have critical heat load and size limits. Other methods use the gas flowing over the pre-cooler fins to regulate gas pressure, but this produces additional thermal noise at the cold finger with flow rate changes.

Thus, there is a need in the art for a long-term thermally stable cooling cryostat with reduced temperature variation due to altitude changes.

SUMMARY OF THE INVENTION

The need in the art is addressed by the present invention which provides a long-term thermally stable cryostat. The cryostat pre-cools an incoming high-pressure gas, converts the incoming gas to a cold liquid, contains the liquid, and cools an item by allowing the liquid to acquire heat from the item and boil into an exhaust gas, while maintaining an absolute pressure in the container to reduce thermal noise due to altitude-induced pressure changes.

In specific embodiments, the cryostat includes a vessel having two walls, with an evacuated space therebetween containing the item to be cooled and the inner wall surrounding a cooling volume. Pre-cooling fins spiral around a hollow mandrel within the cooling volume and circulate an incoming high-pressure gas around the mandrel. A flow restrictor tube having a diameter smaller than the diameter of the pre-cooling fins receives the incoming gas from the pre-cooling fins and releases it into the cooling volume, thereby converting the incoming gas into a cold liquid which can acquire heat from the item and boil into an exhaust gas. A pressure back plate and an O-ring confine a first volume of the exhaust gas flowing past the pre-cooling fins to pre-cool the incoming gas. An absolute pressure regulator in communication with an end of the mandrel receives a second volume of the exhaust gas flowing through the mandrel to maintain an absolute pressure in the cooling volume.

BRIEF DESCRIPTION OF THE DRAWINGS

FIG. 1 is a cross-sectional view of a conventional Joule-Thompson Cryostat.

FIG. 2 is a cross-sectional view of an absolute back pressure cryostat of the present invention.

DESCRIPTION OF THE INVENTION

FIG. 1 shows a Joule-Thompson cryostat 10 of conventional design. High pressure gas such as nitrogen enters at an input port 20. The gas is spiraled around a cryostat mandrel 18 through pre-cooler fins 14 to allow the gas to be pre-cooled. The mandrel 18 is normally sealed to prevent gas from flowing through it. The gas passes into a flow restrictor 24, which is constructed of smaller-diameter tubing than the pre-cooler fins 14. When the gas exits the flow restrictor 24 through port 26, the gas pressure and temperature drop and the expelled nitrogen enters a cooling volume area 28 in a liquid state. The liquid in the cooling volume area 28 cools a cold finger 30. The cold finger 30 conductively cools the IR detectors 12 which are in a dewar vacuum area 22. The liquid acquires heat and is converted to a gas at the vaporization temperature. The gas flows over the pre-cooler fins 14 between the mandrel 18 and a dewar inner wall 16, pre-cooling entering high-pressure warm gas, and is vented to the local atmospheric pressure air.

FIG. 2 depicts an absolute back pressure cryostat 40 constructed in accordance with the teachings of the present invention. A high pressure gas input port 54 is connected to pre-cooler fins 44 which spiral around a hollow cryostat mandrel 52. The hollow mandrel 52 is a tube of a material such as stainless steel that has thermal expansion properties compatible with the other components. A flow restrictor with a port 62 in a cooling volume area 64 is connected to the pre-cooler fins 44 opposite the input port 54. A cold finger 66 in the cooling volume area 64 is disposed adjacent to IR detectors 42 which are in a dewar vacuum area 58 with a dewar inner wall 46. All components in the cooling volume area 64 must have thermal expansion coefficients sufficient to prevent breakage during rapid cooling. The assembly is sealed with an O-ring seal 56 and a pressure back plate 48 having a channel or vent path therein. The O-ring 56 is formed of a material suitable to maintain flexibility at low temperatures and pressures. The pressure back plate 48 is fabricated of a metal such as aluminum with a groove formed therein to seat the O-ring, and to increase safety, may be constructed with two separate interior vent paths (not shown) so that if one path becomes blocked, pressure will not build up and cause damage. A specific flow rate absolute pressure regulator 50 is attached to an end of the hollow mandrel 52. The flow rate, needle orifices and spring pressures within absolute pressure regulator 50 must be optimized to prevent the introduction of pressure modulation noise.

The present invention differs from the conventional Joule-Thompson cryostat of FIG. 1 by the addition of the pressure back plate 48 and O-ring 56 to confine and capture pre-cooler vent gas, the flow path through the center of the cryostat mandrel 52, and the absolute pressure regulator 50 to allow thermally-stable operation at all altitudes.

In operation, high pressure gas enters through the input port 54 and spirals around the hollow cryostat mandrel 52 through the pre-cooler fins 44. The gas then passes through the flow restrictor 60 and exits through the port 62 as a liquid. The liquid in the cooling volume area 64 cools the cold finger 66. The cold finger 66 conductively cools the IR detectors 42 which are in the dewar vacuum area 58. The liquid acquires heat and is converted to a gas. The gas is vented from the cooling volume area 64 through two separate vent paths. A minimal amount of gas flows over the pre-cooler fins 44 between the mandrel 52 and the dewar inner wall 46. The gas venting over the pre-cooler is sealed with the O-ring seal 56 and the pressure back plate 48. The remaining gas is vented through a new vent path down the center of the hollow mandrel 52. The gas flows to the absolute pressure regulator 50. The low flow resistance path from the pressure regulator 50 to the cooling volume 64 allows the pressure in the cooling volume 64 to be held to a constant absolute pressure. To allow operation at normal sea level atmospheric pressure and below, the regulator must be set to a higher pressure, such as 16.7 psia. The absolute pressure regulator 50 allows the gas pressure at the cold finger 66 to be regulated and eliminates the effects of altitude on the boiling point of the coolant. The gas flowing directly to the pressure regulator 50 is not modulated by the flow resistance of the pre-cooling fins, allowing the pressure regulator 50 to more precisely control the temperature of the cold finger 66.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. A long-term thermally stable cryostat, comprising:

means for pre-cooling an incoming high-pressure gas;

means for converting the incoming gas to a cold liquid;

means for containing the liquid;

means for cooling an item by allowing the liquid to acquire heat from the item and boil into an exhaust gas within the containing means;

means for venting the exhaust gas along multiple paths; and means for maintaining an absolute pressure in the containing means.

2. The invention of claim 1 wherein the means for maintaining an absolute pressure includes an absolute pressure regulator.

3. The invention of claim 1 wherein the means for venting the exhaust gas along multiple paths includes a hollow mandrel.

4. The invention of claim 3 wherein the pre-cooling means further includes pre-cooling fins spiraled around the mandrel within a cooling volume.

5. The invention of claim 4 wherein the means for maintaining an absolute pressure includes a pressure back plate having a channel therein.

6. The invention of claim 4 wherein the mandrel has first and second open ends, the first end disposed to receive exhaust gas from the cooling volume and the second end open to the local atmospheric pressure.

7. The invention of claim 6 further including an absolute pressure regulator in communication with the second end of the mandrel to control the pressure in the containing means.

8. The invention of claim 4 wherein the converting means includes a flow restrictor tube having a diameter smaller than the diameter of the pre-cooling fins and positioned to receive the incoming gas from the pre-cooling fins and release the incoming gas into the cooling volume.

9. The invention of claim 4 further including a cold finger, disposed in a cooling area adjacent to the item to be cooled, for transferring heat from the item to the cold liquid.

10. A long-term thermally stable cryostat, comprising:

a vessel having inner and outer walls, the space between the walls being evacuated to form a vacuum area containing an item to be cooled and the inner wall surrounding a cooling volume;

a hollow mandrel and pre-cooling fins spiraled around the mandrel within the cooling volume, the pre-cooling fins circulating an incoming high-pressure gas around the mandrel;

a flow restrictor tube having a diameter smaller than the diameter of the pre-cooling fins and positioned to receive the incoming gas from the pre-cooling fins and release the incoming gas into the cooling volume, thereby converting the incoming gas into a cold liquid which can acquire heat from the item and boil into an exhaust gas;

a pressure back plate having a channel therein which confines a first volume of the exhaust gas flowing past the pre-cooling fins to pre-cool the incoming gas; and an absolute pressure regulator in communication with an end of the mandrel and receiving a second volume of the exhaust gas flowing through the mandrel to maintain an absolute pressure in the cooling volume.

11. A cryogenic thermal noise reduction method, comprising the steps of:

pre-cooling an incoming high-pressure gas;

converting the incoming gas to a cold liquid;

containing the liquid;

cooling an item by allowing the liquid to acquire heat from the item and boil into an exhaust gas within the containing means;

venting the exhaust gas along multiple paths; and maintaining an absolute pressure in the liquid container.

12. A long term thermally stable cryostat, comprising:

means for pre-cooling an incoming high-pressure gas;

means for converting the incoming gas to a cold liquid;

means for containing the liquid;

means for cooling an item by allowing the liquid to acquire heat from the item and boil into an exhaust gas within the containing means;

means for venting the exhaust gas along multiple paths, said means for venting including a hollow mandrel; and means for maintaining an absolute pressure in the containing means, said means for maintaining an absolute pressure includes a pressure back plate having a channel therein in communication with said hollow mandrel.

* * * * *